US008720769B2

(12) United States Patent
Wall et al.

(10) Patent No.: US 8,720,769 B2
(45) Date of Patent: May 13, 2014

(54) BEVERAGE CONTAINER

(75) Inventors: Kerry D. Wall, Grapevine, TX (US); Timothy M. Fraiser, Frisco, TX (US)

(73) Assignee: Packaging Corporation of America, Lake Forest, IL (US)

( * ) Notice: Subject to any disclaimer, the term of this patent is extended or adjusted under 35 U.S.C. 154(b) by 541 days.

(21) Appl. No.: 12/861,601

(22) Filed: Aug. 23, 2010

(65) Prior Publication Data

US 2011/0062223 A1 Mar. 17, 2011

Related U.S. Application Data

(60) Provisional application No. 61/242,684, filed on Sep. 15, 2009.

(51) Int. Cl.
*B65D 5/42* (2006.01)
*B65D 5/56* (2006.01)

(52) U.S. Cl.
USPC ..... 229/109; 229/117.3

(58) Field of Classification Search
USPC ..... 229/462, 117.3, 117.29, 122.31; 222/462; 221/302; 220/495.04
See application file for complete search history.

(56) References Cited

U.S. PATENT DOCUMENTS 1,892,714 A * 1/1933 Wellman ..... 229/109
2,967,655 A * 1/1961 Seger, Jr. ..... 229/109
3,362,574 A 1/1968 Asmus et al. ..... 220/63
3,373,917 A 3/1968 Cox ..... 229/14
3,416,717 A 12/1968 Beck, Jr. et al. ..... 219/14
3,426,955 A 2/1969 Olson ..... 229/17
3,427,646 A 2/1969 Scholle ..... 53/281
3,456,861 A 7/1969 Wettlen ..... 229/17
3,463,357 A 8/1969 MacLean, Jr. et al. ..... 222/94
3,482,758 A 12/1969 Pierre et al. ..... 229/14
3,506,180 A 4/1970 Forrest ..... 229/14
3,517,875 A 6/1970 Wakefield ..... 229/39
3,521,807 A 7/1970 Weisberg ..... 229/14
3,542,566 A 11/1970 Wakefield ..... 99/171
3,547,660 A 12/1970 Weisberg ..... 99/171
3,550,833 A 12/1970 Rahenkamp ..... 229/17
3,567,104 A 3/1971 Arslanian ..... 229/14
3,576,290 A 4/1971 Marchisen ..... 229/38
3,580,465 A 5/1971 Davies ..... 229/14
3,640,447 A 2/1972 Forbes, Jr. et al. ..... 229/17 R
3,746,240 A 7/1973 Flynn ..... 229/14
3,756,471 A 9/1973 Wissman ..... 222/156
3,902,652 A 9/1975 Malcolm ..... 229/14
3,907,169 A 9/1975 Gortz et al. ..... 222/95
3,938,728 A 2/1976 Deards et al. ..... 229/14
3,944,127 A 3/1976 Bruke et al. ..... 229/14
3,952,940 A 4/1976 Malcolm ..... 229/14
4,019,628 A 4/1977 Derby ..... 206/524.4
4,076,147 A 2/1978 Schmit ..... 222/89
4,109,822 A 8/1978 Egli ..... 220/404

(Continued)

*Primary Examiner* — Gary Elkins
*Assistant Examiner* — Christopher Demeree
(74) *Attorney, Agent, or Firm* — Nixon Peabody LLP

(57) ABSTRACT

According to one embodiment, a container includes at least eight side panels having generally the same dimensions. The at least eight side panels form an enclosure. One of the at least eight side panels includes a first access opening that is integrally formed therein. The first access opening permits access to the interior of the enclosure. The container further includes a top panel connected to one or more of the at least eight side panels. The top panel forms a second access opening for providing access to the interior of the enclosure. The container also includes a bottom panel connected to one or more of the at least eight side panels.

19 Claims, 2 Drawing Sheets

(56) References Cited

U.S. PATENT DOCUMENTS

| | | | | | |
|---|---|---|---|---|---|
| 4,154,346 | A | | 5/1979 | Heuberger | 206/629 |
| 4,174,051 | A | | 11/1979 | Edwards et al. | 222/105 |
| 4,184,608 | A | | 1/1980 | Christensson | 220/404 |
| 4,197,962 | A | | 4/1980 | Edwards | 220/461 |
| 4,245,743 | A | | 1/1981 | Heuberger | 206/611 |
| 4,266,698 | A | | 5/1981 | Rausing | 222/528 |
| 4,304,353 | A | * | 12/1981 | Stollberg | 229/126 |
| 4,401,239 | A | | 8/1983 | Thomassen | 222/183 |
| 4,454,945 | A | | 6/1984 | Jabarin et al. | 206/524.3 |
| 4,471,884 | A | | 9/1984 | Kuchenbecker | 220/462 |
| 4,488,661 | A | | 12/1984 | Homma | 220/462 |
| 4,524,883 | A | | 6/1985 | Herring | 220/462 |
| 4,549,673 | A | | 10/1985 | Kupersmit | 220/465 |
| 4,560,090 | A | | 12/1985 | Okushita | 222/81 |
| 4,565,315 | A | | 1/1986 | Wagner et al. | 229/17 |
| 4,572,422 | A | | 2/1986 | Heuberger et al. | 229/7 R |
| 4,623,075 | A | | 11/1986 | Riley | 222/95 |
| 4,660,737 | A | | 4/1987 | Green et al. | 220/410 |
| 4,673,125 | A | | 6/1987 | Weaver | 229/17 |
| 4,696,840 | A | | 9/1987 | McCullough et al. | 220/462 |
| 4,736,870 | A | | 4/1988 | Christensson | 220/461 |
| 4,771,917 | A | * | 9/1988 | Heaps et al. | 222/92 |
| 4,786,192 | A | | 11/1988 | Graves et al. | 383/119 |
| 4,815,631 | A | | 3/1989 | Eeg et al. | 220/403 |
| 4,816,093 | A | | 3/1989 | Robbins, III | 156/69 |
| 4,854,474 | A | | 8/1989 | Murray et al. | 220/462 |
| 4,872,588 | A | | 10/1989 | Texidor | 220/403 |
| 4,890,761 | A | | 1/1990 | Gaves | 220/404 |
| 4,890,772 | A | | 1/1990 | Heuberger et al. | 222/156 |
| 4,898,301 | A | | 2/1990 | Schick | 220/408 |
| 4,927,037 | A | | 5/1990 | Boots | 220/1.5 |
| 4,953,739 | A | | 9/1990 | Wooge et al. | 220/93 |
| 4,968,624 | A | | 11/1990 | Bacehowski et al. | 435/287 |
| 5,042,682 | A | | 8/1991 | Ritter et al. | 220/403 |
| 5,048,691 | A | | 9/1991 | Heuberger et al. | 206/611 |
| 5,050,775 | A | | 9/1991 | Marquardt | 222/93 |
| 5,054,644 | A | | 10/1991 | Greenslade | 220/403 |
| 5,074,429 | A | | 12/1991 | Komel et al. | 220/410 |
| 5,092,486 | A | | 3/1992 | vom Hofe et al. | 220/465 |
| 5,147,062 | A | | 9/1992 | Heuberger et al. | 220/410 |
| 5,156,294 | A | | 10/1992 | Nichols | 220/403 |
| 5,156,295 | A | | 10/1992 | Gordon et al. | 220/416 |
| 5,197,625 | A | | 3/1993 | Mullaney | 220/418 |
| 5,199,594 | A | | 4/1993 | Obara et al. | 220/403 |
| 5,201,462 | A | | 4/1993 | Sada et al. | 229/125.15 |
| 5,203,470 | A | | 4/1993 | Brown | 220/462 |
| 5,211,305 | A | | 5/1993 | Horton | 220/461 |
| 5,246,162 | A | | 9/1993 | Heuberger et al. | 229/216 |
| 5,259,550 | A | | 11/1993 | Kuchenbecker | 229/109 |
| 5,265,753 | A | | 11/1993 | Moorman | 220/465 |
| 5,275,332 | A | | 1/1994 | Heuberger et al. | 229/216 |
| 5,314,088 | A | | 5/1994 | Heuberger et al. | 220/465 |
| 5,356,022 | A | | 10/1994 | Tipps | 220/404 |
| 5,427,267 | A | | 6/1995 | Willman | 220/403 |
| 5,462,169 | A | | 10/1995 | Dygert et al. | 206/521 |
| 5,482,179 | A | | 1/1996 | Bruhn | 220/410 |
| 5,484,077 | A | | 1/1996 | Albanesi et al. | 220/404 |
| 5,562,227 | A | | 10/1996 | Takezawa et al. | 220/403 |
| 5,627,150 | A | | 5/1997 | Peterson et al. | 510/439 |
| 5,715,992 | A | | 2/1998 | Andrews, Sr. et al. | 229/125.15 |
| 5,749,489 | A | * | 5/1998 | Benner et al. | 229/117.3 |
| 5,750,216 | A | | 5/1998 | Horino et al. | 428/34.3 |
| 5,788,121 | A | | 8/1998 | Sasaki et al. | 222/105 |
| 5,794,811 | A | | 8/1998 | Walsh | 220/462 |
| 5,794,812 | A | | 8/1998 | Walsh | 220/462 |
| 5,799,818 | A | | 9/1998 | Ringer | 220/462 |
| 5,803,302 | A | | 9/1998 | Sato et al. | 220/462 |
| 5,857,614 | A | | 1/1999 | Walsh | 229/231 |
| 5,909,841 | A | | 6/1999 | Andrews, Sr. et al. | 229/125.15 |
| 5,918,799 | A | | 7/1999 | Walsh | 229/164.2 |
| 6,053,401 | A | | 4/2000 | Andrews, Sr. | 229/117.3 |
| 6,062,431 | A | | 5/2000 | Geshay | 222/105 |
| 6,062,467 | A | | 5/2000 | Ours et al. | 229/117 |
| 6,102,568 | A | | 8/2000 | Davis | 383/43 |
| 6,116,499 | A | | 9/2000 | Todjar-Hengami | 229/117.3 |
| 6,145,736 | A | | 11/2000 | Ours et al. | 229/117.3 |
| 6,182,887 | B1 | | 2/2001 | Ljunstrom et al. | 229/117 |
| 6,196,452 | B1 | | 3/2001 | Andrews, Sr. et al. | 229/125.15 |
| 6,206,279 | B1 | | 3/2001 | Countee | 229/117.27 |
| 6,213,388 | B1 | | 4/2001 | Ours et al. | 229/117.3 |
| 6,223,981 | B1 | | 5/2001 | Gunder | 229/242 |
| 6,227,440 | B1 | | 5/2001 | Hart | 229/117.3 |
| 6,227,441 | B1 | | 5/2001 | Sagel et al. | 229/117.35 |
| 6,237,841 | B1 | | 5/2001 | Tsutsui | 229/117.35 |
| 6,253,993 | B1 | | 7/2001 | Lloyd et al. | 229/117.3 |
| 6,273,332 | B1 | | 8/2001 | Todjar-Hengami | 229/129.1 |
| 6,290,124 | B2 | | 9/2001 | Andrews, Sr. et al. | 229/117.27 |
| 6,318,626 | B1 | | 11/2001 | St. Pierre et al. | 229/117.3 |
| 6,360,942 | B2 | | 3/2002 | Todjar Hengami | 229/129.1 |
| 6,386,438 | B1 | | 5/2002 | Walsh et al. | 229/117.27 |
| 6,416,221 | B2 | | 7/2002 | Price | 383/63 |
| 6,435,402 | B1 | | 8/2002 | Hengami | 229/120.03 |
| 6,443,329 | B1 | | 9/2002 | Rochefort et al. | 222/105 |
| 6,474,040 | B1 | | 11/2002 | Ours et al. | 53/133.3 |
| 6,519,436 | B2 | | 2/2003 | Katsuyama | 399/258 |
| 6,637,623 | B2 | | 10/2003 | Muise et al. | 222/105 |
| 6,648,218 | B2 | | 11/2003 | Katsuyama et al. | 229/117.35 |
| RE38,377 | E | | 1/2004 | Geshay | 222/105 |
| 6,755,324 | B2 | | 6/2004 | Geshay | 222/1 |
| 6,889,892 | B2 | | 5/2005 | Walsh et al. | 229/117.31 |
| 7,036,714 | B2 | | 5/2006 | Walsh et al. | 229/117.27 |
| 7,040,528 | B2 | | 5/2006 | Hengami | 229/117.3 |
| 7,077,309 | B2 | | 7/2006 | Andrews, Sr. | 229/117.15 |
| 7,090,115 | B2 | | 8/2006 | Pierce | 229/109 |
| 7,097,092 | B1 | | 8/2006 | Marrale | 229/117.35 |
| 7,210,612 | B2 | | 5/2007 | Walsh et al. | 229/117.27 |
| 7,350,670 | B2 | | 4/2008 | Steeves et al. | 222/105 |
| 7,377,420 | B2 | | 5/2008 | Gardner | 229/122.23 |
| 7,389,909 | B2 | | 6/2008 | Crosland et al. | 229/117.35 |
| 7,621,439 | B2 | * | 11/2009 | McClure | 229/120.32 |
| 2001/0004994 | A1 | | 6/2001 | Andrews, Sr. et al. | 229/125.15 |
| 2002/0047040 | A1 | | 4/2002 | Andrews, Sr. et al. | 229/112 |
| 2002/0060240 | A1 | | 5/2002 | Walsh et al. | 229/117.27 |
| 2003/0059130 | A1 | | 3/2003 | Yoneyama et al. | 383/10 |
| 2003/0136819 | A1 | | 7/2003 | Walsh et al. | 229/117.3 |
| 2003/0168501 | A1 | | 9/2003 | Hengami | 229/117.3 |
| 2004/0188504 | A1 | * | 9/2004 | Pierce | 229/109 |
| 2005/0127150 | A1 | | 6/2005 | Walsh et al. | 229/117.3 |
| 2005/0133578 | A1 | | 6/2005 | Farha et al. | 229/117.3 |
| 2005/0211754 | A1 | | 9/2005 | Fulcher | 229/117.3 |
| 2005/0224564 | A1 | | 10/2005 | Walsh | 229/117.27 |
| 2005/0269388 | A1 | | 12/2005 | Eguizabal | 229/117.3 |
| 2006/0112717 | A1 | | 6/2006 | Walton | 62/371 |
| 2006/0144910 | A1 | | 7/2006 | Wachter | 229/117.3 |
| 2006/0180643 | A1 | | 8/2006 | Stephenson | 229/117.3 |
| 2006/0202003 | A9 | | 9/2006 | Walsh et al. | 229/117.3 |
| 2006/0202004 | A1 | | 9/2006 | Holt | 229/117.3 |
| 2006/0202005 | A1 | | 9/2006 | Andrews, Sr. et al. | 229/117.3 |
| 2006/0243783 | A1 | | 11/2006 | Spivey, Sr. et al. | 229/117.3 |
| 2006/0266810 | A1 | | 11/2006 | Foushee | 229/101.2 |
| 2006/0273142 | A1 | | 12/2006 | Pierce | 229/109 |
| 2007/0095881 | A1 | | 5/2007 | Manaige | 229/101.2 |
| 2007/0119914 | A1 | | 5/2007 | Mestre et al. | 229/117.34 |
| 2007/0164092 | A1 | | 7/2007 | Biundo | 229/117.3 |
| 2007/0187471 | A1 | | 8/2007 | Ford | 229/117.34 |
| 2007/0221714 | A1 | | 9/2007 | Ours | 229/117.35 |
| 2007/0228121 | A1 | | 10/2007 | McKenna et al. | 229/117.13 |
| 2007/0228122 | A1 | | 10/2007 | McKenna et al. | 229/117.13 |
| 2007/0228123 | A1 | | 10/2007 | McKenna et al. | 229/117.13 |
| 2007/0228127 | A1 | | 10/2007 | Gardner | 229/122.23 |
| 2008/0083777 | A1 | | 4/2008 | Lips | 222/105 |
| 2008/0086102 | A1 | | 4/2008 | Coats et al. | 604/317 |
| 2008/0087713 | A1 | | 4/2008 | Deniston et al. | 229/117.27 |
| 2008/0099541 | A1 | * | 5/2008 | Smith et al. | 229/109 |
| 2008/0245848 | A1 | | 10/2008 | Plunkett et al. | 229/117.3 |
| 2008/0264970 | A1 | | 10/2008 | Kasai | 222/105 |
| 2008/0265009 | A1 | | 10/2008 | Katoh | 229/117.16 |
| 2008/0308616 | A1 | | 12/2008 | Phung | 229/117.27 |
| 2009/0050682 | A1 | | 2/2009 | Cole et al. | 229/117.3 |
| 2009/0084834 | A1 | | 4/2009 | Duyst | 229/117.3 |
| 2009/0101699 | A1 | | 4/2009 | Goudreau et al. | 229/117.27 |

* cited by examiner

BEVERAGE CONTAINER

CROSS-REFERENCE TO RELATED APPLICATION

This application claims the benefit of U.S. Provisional Patent Application No. 61/242,684, filed Sep. 15, 2009 titled "Beverage Container," which is hereby incorporated by reference in its entirety.

FIELD OF THE INVENTION

The present invention relates generally to beverage containers. In particular, the present invention relates to an octagon-shaped beverage container.

BACKGROUND

Wine has traditionally been stored, transported, and sold in corked or screw-capped glass bottles. When a bottle is opened, the wine inside is exposed to air causing a chemical reaction known as oxidation. If the wine is not consumed quickly enough, oxidation can lead to undesirable changes in color, aroma and taste.

As an alternative to bottling, wine producers and distributors are increasingly storing, transporting and selling wine in collapsible bags disposed within boxes. A pour spout attached to the bottom of the bag is accessible through a hole in the box. As wine is poured from the pour spout, the bag collapses. Thus, the wine inside the bag is never exposed to the air and oxidation is prevented.

While "boxed wine" is more efficient and superior to bottled wine for this reason, some consumers have resisted wine containers other than glass bottles. This is due in part to tradition and in part to pervasive and often incorrect perceptions that "boxed wine" is of lesser quality.

SUMMARY

According to one embodiment, a container includes at least eight side panels having generally the same dimensions. The at least eight side panels form an enclosure. One of the at least eight side panels includes a first access opening that is integrally formed therein. The first access opening permits access to the interior of the enclosure. The container further includes a top panel connected to one or more of the at least eight side panels. The top panel forms a second access opening for providing access to the interior of the enclosure. The container also includes a bottom panel connected to one or more of the at least eight side panels.

According to another embodiment, a container includes eight side panels having generally the same dimensions. One of the eight side panels includes a first access opening formed integrally therein. The first access opening permits access to the interior of the container. The container also includes an octagonal top panel connected to at least one of the eight side panels. The top panel forms a second access opening. The container further includes an octogonal bottom panel and a flexible bag. The flexible bag is disposed within an enclosure defined by the eight side panels.

According to one embodiment, a method of assembling a container includes providing a blank that has at least eight side panels of generally the same dimensions. One of the at least eight side panels includes a first access opening integrally formed therein for permitting access to an interior of the container. The blank further has an attachment side panel joined to one of the side panels, at least a first foldable bottom panel associated with one of the side panels by a first fold line, a second foldable bottom panel associated with one of the side panels by a second fold line, at least a first foldable top panel associated with one of the side panels by a third fold line, and a second foldable top panel associated with one of the side panels by a fourth fold line. The method further includes folding the blank such that the attachment side panel is generally adjacent to one of the side panels, attaching the attachment side panel to the adjacent side panel to form an enclosure, folding the first bottom panel inward at the first fold line, and folding the second bottom panel inward at the second fold line. At least one aperture is formed between the at least eight side panels, the first bottom panel, and the second bottom panel. The method still further includes inserting a flexible bag into the enclosure, folding the first top panel inward at the third fold line, and folding the second top panel inward at the fourth fold line so as to form an enclosed container having a flexible bag therein. The at least one aperture assists in venting air from the container during the insertion of the flexible bag.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
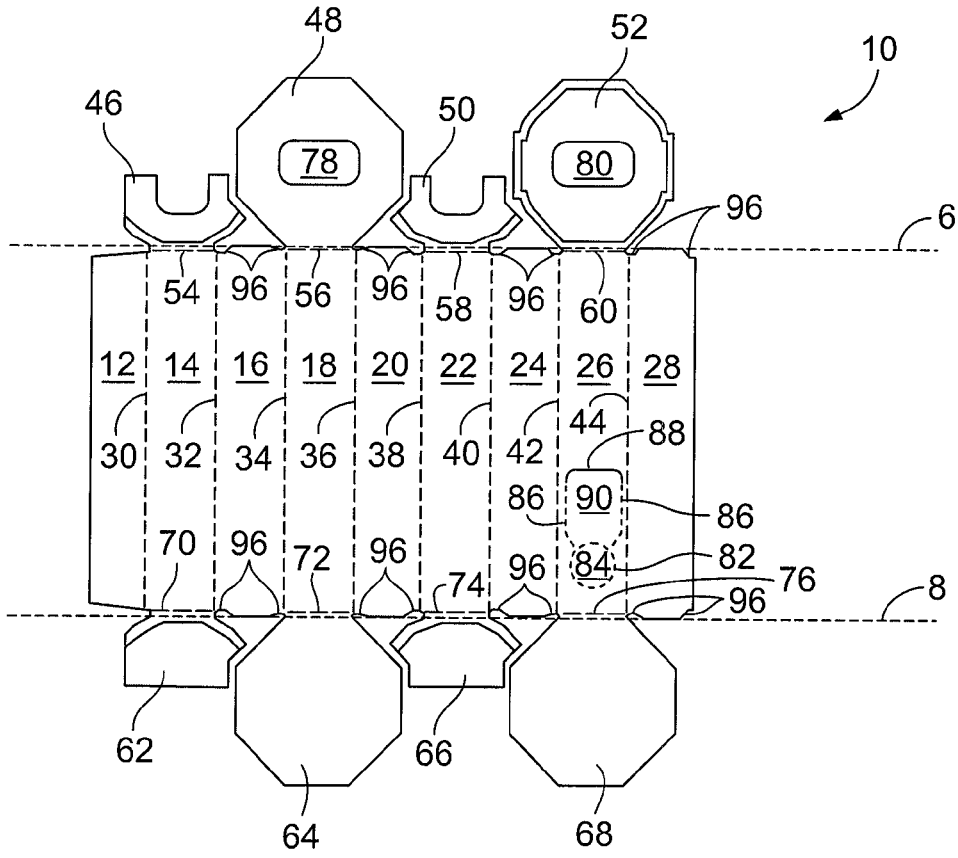
FIG. 1 is a plan view of a blank for forming a container according to one embodiment.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 2:
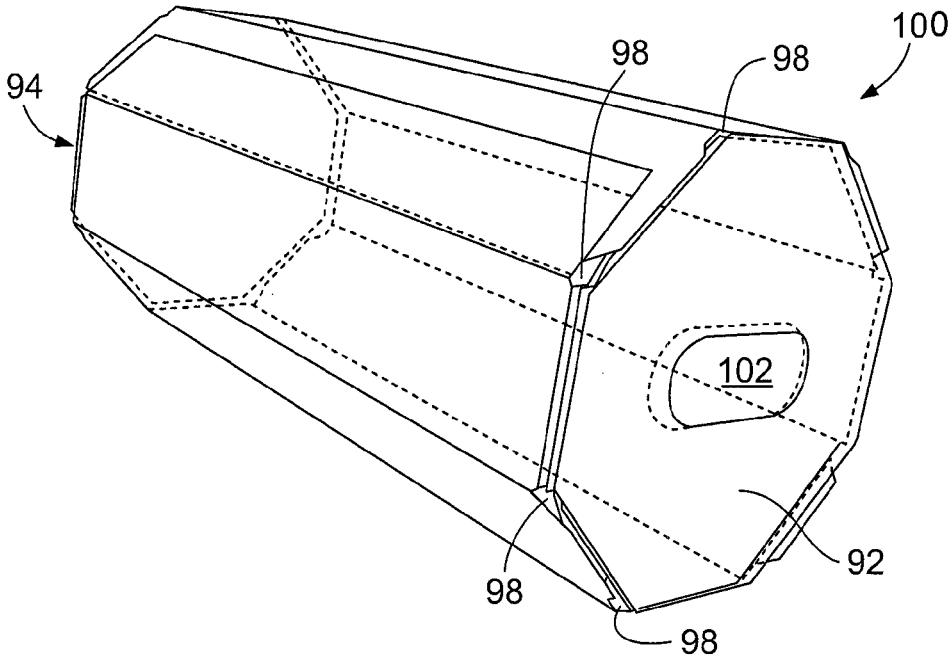
FIG. 2 is a perspective view of the container formed from the blank of FIG. 1.
Figure 3A:
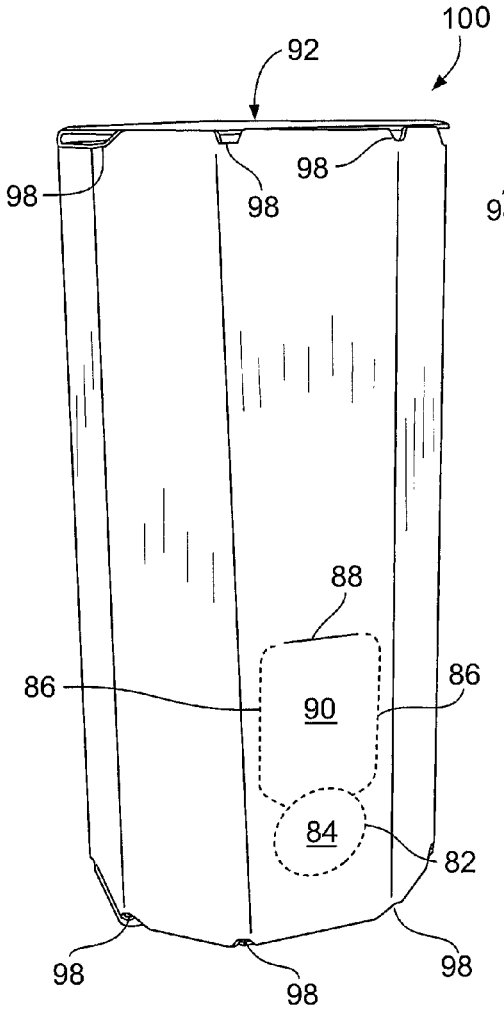
FIG. 3*a* is another perspective view of the container formed from the blank of FIG. 1.
Figure 3B:
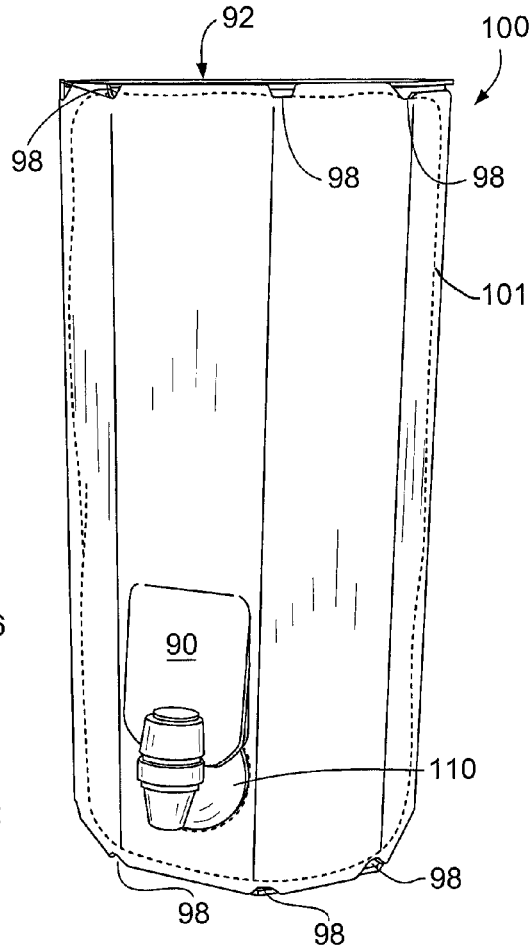
FIG. 3*b* is still another perspective view of the container formed from the blank of FIG. 1 including a flexible bag and pour spigot.

FIG. 1 illustrates a plan view of a blank 10 for forming an octagonal-shaped beverage container 100 (FIGS. 2, 3*a*, and 3*b*) according to one embodiment of the present invention. The blank 10 includes an attachment panel 12, a first side panel 14, a second side panel 16, a third side panel 18, a fourth side panel 20, a fifth side panel 22, a sixth side panel 24, a seventh side panel 26, and an eighth side panel 28. Adjacent panels 12, 14, 16, 18, 20, 22, 24, 26, 28 are connected with one another by substantially parallel creases or fold lines 30, 32, 34, 36, 38, 40, 42, 44. For example, the first side panel 14 is connected to the second side panel 16 by a fold line 32. The fold lines 30, 32, 34, 46, 38, 40, 42, 44 are generally perpendicular to a top plane 6 and a bottom plane 8. The attachment panel 12 is configured to attach, adhere or bond to the eighth side panel 28 to form the octagonal-shaped container 100 as described in further detail below.

It has been discovered that wine consumers generally find the octagon-shaped container 100 more appealing than conventional "boxed wine" containers, which are typically configured with a rectangular or square shape. The octagon-shaped container 100 is perceived as less "box-like" and more closely resembling a glass wine bottle shape, placating traditionalists and assisting in mitigating the aforementioned misconceptions associated with "boxed wine." While the octagon-shaped container 100 has been found to achieve the aforementioned advantages, it is also contemplated that the container 100 can have more than eight sides to achieve a container that is perceived as a less "box-like" container and more closely resembles a glass wine bottle shape.

The blank 10 further includes a first minor top flap 46, a first major top flap 48, a second minor top flap 50, and a second major top flap 52 hingedly secured to the side panels 14, 18, 22, 26 by top fold lines 54, 56, 58, 60, respectively. Similarly, the blank 10 includes a first minor bottom flap 62, a first major bottom flap 64, a second minor bottom flap 66, and a second major bottom flap 68 hingedly secured to the side panels 14, 18, 22, 26 by bottom fold lines 70, 72, 74, 76, respectively. The top fold lines 54, 56, 58, 60 and the bottom fold lines 70, 72, 74, 76 are generally parallel to the top plane 6 and the bottom plane 8. It is contemplated that, according to alternative embodiments, the top flaps 46, 48, 50, 52 and the bottom flaps 62, 64, 66, 68 can be hingedly secured to any other suitable combination of side panels 14, 16, 18, 20, 22, 24, 26, 28 (e.g., the first major top flap 48 is secured to side panel 14, the first minor top flap 46 is secured to side panel 18, the second major top flap 52 is secured to side panel 22, and the second minor top flap 50 is secured to side panel 26).

To facilitate assembly of the blank 10 in forming the container 100, the top fold lines 54, 56, 58, 60 can be offset by varying distances from the top plane 6. The offset of each top fold line 54, 56, 58, 60 is selected such that the minor top flaps 46, 50 and the major top flaps 48, 52 can be folded along the top fold line 54, 56, 58, 60 at approximately a ninety-degree angle relative to the position shown in FIG. 1 to form a top surface 92 (shown in FIG. 2) that is generally flush with the top plane 6 and generally perpendicular with the side panels 14, 16, 18, 20, 22, 24, 26, 28. According to one non-limiting example, the minor top flaps 46, 50 are offset by a distance equal to approximately the thickness of the material comprising the blank 10 and the second major top flap 52 is offset by a distance equal to approximately twice the thickness of the material comprising the blank 10. Similarly, the bottom fold lines 70, 72, 74, 76 can be offset by varying distances from the bottom plane 8 to facilitate assembly and form a bottom surface 94 (shown in FIG. 2) of the container 100 that is generally flush with the bottom plane 8 and generally perpendicular to the side panels 14, 16, 18, 20, 22, 24, 26, 28.

Optionally, each side panel 16, 20, 24, 28 that is not hingedly secured to a top flap 46, 48, 50, 52 and/or a bottom flap 62, 64, 66, 68 can include one or more notches 96 along the peripheral edges of the side panels 16, 20, 24, 28. When the blank 10 is assembled into the container 100, the notches 96 form gaps 98 (shown in FIGS. 2-3*b*) between the top surface 92 and the side panels 14, 16, 18, 20, 22, 24, 26, 28 as described in further detail below.

In the illustrated embodiment, the seventh side panel 26 includes a perforation line 82 that defines a generally circular pop-out panel 84. As such, the pop-out panel 84 is configured to be easily removed by a person assembling the blank 10 into the container 100 or a consumer. The seventh side panel 26 further includes a perforation line 86 and a fold line 88 that, in conjunction with the perforation line 82, define a fold-out panel 90. In alternative embodiments, any of the side panels 14, 16, 18, 20, 22, 24, 26, 28 can include the pop-out panel 84 and the fold-out panel 90.

The assembly of the blank 10 into the container 100 will now be described. When the attachment panel 12 is attached, adhered or joined to the eighth side panel 28, an octagon-shaped, tubular enclosure is formed or defined by the first through eighth side panels 14, 16, 18, 20, 22, 24, 26, 28.

The second major bottom flap 68 is folded inwards along the bottom fold line 76 at about a ninety-degree angle from the position illustrated in FIG. 1. The first and second minor bottom flaps 62, 66 are then folded inwards at about a ninety-degree angle along the bottom fold lines 70, 74 and attached to the outer surface of the second major bottom flap 68. The first major bottom flap 64 is then folded inwards along the bottom fold line 72 and attached to the outer surface of the first and second minor bottom flaps 62, 66. Thus assembled, the bottom flaps 62, 64, 66, 68 form a bottom surface 94 that is generally flush with the bottom plane 8 and generally perpendicular to the side panels 14, 16, 18, 20, 22, 24, 26, 28. The bottom flaps 62, 64, 66, 68 can be shaped and structured to contact and support the side panels 14, 16, 18, 20, 22, 24, 26, 28, thereby reinforcing the octagon-shaped enclosure defined by side panels 14, 16, 18, 20, 22, 24, 26, 28. When the bottom fold lines 70, 72, 74, 76 are offset from the bottom plane 8, as described above, the bottom flaps 62, 64, 66, 68 can be recessed within the enclosure, providing enhanced structural support and reinforcement.

Once the bottom flaps 62, 64, 66, 68 are assembled, a flexible beverage bag 101 may be inserted in the container 100. The beverage bag 101 can be manufactured from any suitable material including, but not limited to, plastics, metalized films, and/or a combination thereof. The bag 101 is shaped and sized to fit within the container 100. Thus, the bag 101 is disposed within the volume defined by the eight side panels, the bottom panel and the top panel of the container 100. The bag 101 is typically coupled to a mouth in which the mouth extends through an access opening. The mouth is sized and shaped such that fluid can be poured therethrough.

As shown in FIGS. 1-3*b*, the notches 96 provided on the side panels 16, 20, 24, 28 form gaps 98 between the bottom surface 94 and the side panels 16, 20, 24, 28. The gaps 98 advantageously assist in venting air from the container 100 during insertion of the beverage bag 101. Without the gaps 98, venting is limited and the air displaced by the volume of a filled beverage bag 101 exerts an upward force opposing the insertion of the beverage bag 101.

The beverage bag 101 includes a pour spout 110 (shown in FIG. 3*b*) for pouring the beverage from the beverage bag 101. To accommodate and provide access to the pour spout 110, the pop-out panel 84 can be removed, defining an opening that is configured to receive the pour spout 110. Folding the fold-out panel 90 along the fold line 88 provides greater access to the interior of the container 100 and facilitates insertion of the pour spout 110 into the opening. It is contemplated that the pour spout 110 can be inserted into the opening at the time of assembly of the blank 10 into the container 100 or at some later point in time.

With the beverage bag 101 positioned within the enclosure, the top flaps 54, 56, 58, 60 can be assembled. The second major top flap 52 is first folded inwards along the top fold line 60 at about a ninety-degree angle from the position illustrated in FIG. 1. Next, the minor top flaps 46, 50 are folded inwards at about a ninety-degree angle along the top fold lines 54, 58 and attached to the outer surface of the second major top flap 52. The first major top flap 48 is then folded inwards along top fold line 56 and attached to the outer surface of the first and second minor top flaps 46, 50. The top flaps 46, 48, 50, 52 can be shaped and structured to contact and support the side panels 14, 16, 18, 20, 22, 24, 26, 28, thereby reinforcing the octagon-shaped enclosure defined by side panels 14, 16, 18, 20, 22, 24, 26, 28. When the top fold lines 54, 56, 58, 60 are offset from the top plane 6, as described above, the top flaps 46, 48, 50, 52 can be recessed within the container 100, providing enhanced structural support and reinforcement.

According to the illustrated embodiment of FIGS. 1-3*b*, the first major top flap 48 includes a first aperture 78 formed therein, and the second major top flap 52 includes a second aperture 80 formed therein. As a non-limiting example, the first aperture 78 has a length of about 2.5 inches (i.e., about 6.35 cm) and width of about 1.5 inches (i.e., about 3.5 cm) and the second aperture 80 has a length of about 2.5 inches (about 6.7 cm) and a width of about 1.5 inches (i.e., about 6.7 cm). As another non-limiting example, the first aperture 78 has a length of about 0.5 inches to 5.0 inches (i.e., about 1.27 cm to about 12.7 cm) and width of about 0.5 inches to 2.5 inches (i.e., about 1.27 cm to about 6.35 cm) and the second aperture 80 has a length of about 0.5 inches to 5.0 inches (i.e., about 1.27 cm to about 12.7 cm) and width of about 0.5 inches to 2.5 inches (i.e., about 1.27 cm to about 6.35 cm). The first minor top flap 46 and the second minor top flap 48 are shaped such that when the top surface 92 is assembled, an access port 102 is formed in the top surface 92 of the container 100. The access port 102 provides access to the interior of the container 100 without having to disassemble each of the top flaps 46, 48, 50, 52. This is particularly advantageous when the pour spout 110 is not inserted into the opening at the time of assembly. For example, shipping of the container 100 may cause the beverage bag 101 to shift such that the pour spout 110 is no longer located directly behind the pop-out panel 84 and the fold-out panel 90. The consumer can thus use the access opening or port 102 to manipulate the beverage bag 101 from above to assist in locating the pour spout 110 through the pop-out panel 84 and the fold-out panel 90.

According to some embodiments, perforated lines defining pop-out panels can form the apertures 78, 80. According to the illustrated embodiment, the apertures 78, 80 are provided in a generally central region of the top flaps 48, 52. It is contemplated that the apertures 78, 80 can be positioned in any other suitable location on the top flaps 48, 52. It is contemplated that the access port 102 can be configured to have any suitable shape and size to provide access to the interior of the container 100. And while the illustrated container 100 includes a single access port 102, it is contemplated that, according to some embodiments, two or more access ports 102 may be provided in the top surface 92 of the container 100.

According to some embodiments, the assembled container 100 is configured to fit in a consumer's refrigerator. This is particularly desirable when the beverage bag 101 is filled with white wine, which is typically consumed at a temperature below room temperature. As one non-limiting example, the bottom surface 94 of the assembled container 100 has a footprint size of about 5 inches (i.e., about 13 cm) by about 5 inches (i.e., about 13 cm), the side panels 14, 16, 18, 20, 22, 24, 26, 28 have a height of about 11 inches (i.e., about 27.5 cm) and a width of about 2 inches (i.e., about 5.3 cm), and the first major top flap 48 and the first major bottom flap 64 have a height of about 5 inches (i.e., about 13 cm) and a width of about 5 inches (i.e., about 13 cm). As another non-limiting example, the bottom surface 94 of the assembled container 100 has a footprint size of about 2.5 inches to 16.0 inches (i.e., about 6.35 cm to about 40.64 cm) by about 2.5 inches to 16.0 inches (i.e., about 6.35 cm to about 40.64 cm), the side panels 14, 16, 18, 20, 22, 24, 26, 28 have a height of about 5.0 inches to 30.0 inches (i.e., about 12.7 cm to about 76.2 cm) and a width of about 1.0 inches to 6.0 inches (i.e., about 2.54 cm to about 15.24 cm), and the first major top flap 48 and the first major bottom flap 64 have a height of about 2.5 inches to 16.0 inches (i.e., about 6.35 cm to about 40.64 cm) and a width of about 2.5 inches to 16.0 inches (i.e., about 6.35 cm to about 40.64 cm).

Advantageously, the octagon-shaped container 100 can have eight sides of generally equal widths. It is believed that a container 100 having such a configuration can be more efficiently refrigerated due to the more even distribution of cold air across the surface area of the container 100. Additionally, the inclusion of the notches 96 forming gaps 98 between the top and bottom surfaces 92, 94 and the side panels 14, 16, 18, 20, 22, 24, 26, 28 provides greater access of cold air to the beverage bag 101 inside the container 100. With equally sized side panels 14, 16, 18, 20, 22, 24, 26, 28, the gaps 98 can be uniformly distributed on the container 100, further enhancing access of cold air to the beverage bag 101. Equally sized side panels 14, 16, 18, 20, 22, 24, 26, 28 is also advantageous because uniformly spaced gaps 98 provide more efficient venting when the beverage bag 101 is assembled into the container 100. Still further, it has been found that when the container 100 has equally dimensioned sides, the container 100 is more aesthetically pleasing to consumers because it more closely resembles the look of a glass wine bottle shape and, thus, more effectively overcomes the misconceptions associated with "boxed-wine" explained above. Therefore, the container 100 has both functional and aesthetic reasons for including at least eight sides having generally equal dimensions.

While it is advantageous that the sides of the container have generally equal dimensions, in some embodiments, it may be necessary for the side panel that provides an opening for a pour spout to have a greater width than the other side panels. Specifically, if the footprint of a container is desired to be small but a desired pour spout requires an opening having a diameter that is large in relation to the width of the other side panels, it may be necessary for one side panel to be larger than the others. For example, referring to the container 100 of FIGS. 1-3*b*, if a desired pour spout 110 requires an opening 84 having a diameter of about 1 inch (i.e., about 2.54 cm) and the desired footprint of the container 100 provides that the side panels 14, 16, 18, 20, 22, 24, 28 have a width of about 1 inch (i.e., about 2.54 cm), the side panel 26 that provides the opening 84 can have a width that is larger than about 1 inch (i.e., about 2.54 cm) to accommodate the desired pour spout 110. It is also contemplated that, in some of such embodiments, the side panel 18 directly opposite of the side panel 26 providing the opening 84 for the pour spout 110 can also have the same width as the side panel 26 to mitigate the loss of aesthetic appeal of the container 100 by not having equally dimensioned side panels. While embodiments having sides that are not equally dimensioned are less effective at overcoming misconceptions of consumers associated with "boxed-wine" than embodiments having sides of generally the same dimensions, such embodiments still retain some of the functional advantages associated with providing gaps (e.g., the gaps 98) that assist in venting and cooling the interior of the container.

The containers of the embodiments described herein are typically manufactured using corrugated paperboard, preferably with the corrugations running in a vertical direction for increased strength. As non-limiting examples, the container 100 is manufactured from E-flute or B-flute corrugated paperboard. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials. It is also contemplated that the container 100 may include advertising features, descriptions, graphics, or other information.

While the containers of the embodiments described above include glue or adhesive for joining various panels and flaps of the containers, it is contemplated that any other suitable method of joining or attaching panels and flaps may be utilized such as, for example, a system of corresponding slits and tabs. Additionally, it is contemplated that the container can include only one or no minor top and/or bottom flaps. Further, it is contemplated that beverages other than wine may be included in the beverage bag of the container 100.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container comprising:

at least eight side panels having generally the same dimensions, the at least eight side panels forming an enclosure, one of the at least eight side panels including a first access opening integrally formed therein for permitting access to the interior of the enclosure;

a top panel connected to one or more of the at least eight side panels, the top panel forming a second access opening for providing access to the interior of the enclosure;

a bottom panel connected to one or more of the at least eight side panels;

a flexible bag disposed within the enclosure; and a plurality of first gaps formed between the bottom panel and the at least eight side panels to assist in venting air from the container during insertion of the flexible bag or increase thermal communication between the interior of the enclosure and an environment exterior to the enclosure, wherein the at least eight side panels includes only eight side panels and the plurality of first gaps includes eight first gaps, each of the eight first gaps being aligned with a respective fold line between adjacent ones of the eight side panels such that the eight first gaps are equally spaced around a perimeter of the container.

2. The container of claim 1, wherein the at least eight side panels are integrally connected to one another by fold lines.

3. The container of claim 1, wherein the first access opening is defined by a pop-out panel in the one of the at least eight side panels.

4. The container of claim 3, wherein the first access opening is further defined by a fold-out panel adjacent to the pop-out panel.

5. The container of claim 1, further comprising a plurality of second gaps formed between the top panel and the at least eight side panels to increase thermal communication between the interior of the enclosure and an environment exterior to the enclosure.

6. The container of claim 1, wherein the bottom panel is recessed within the enclosure.

7. The container of claim 1, further comprising a plurality of second gaps formed between the top panel and the eight side panels, each of the plurality of second gaps being aligned with a respective one of the plurality of first gaps.

8. The container of claim 1, wherein the second access opening is defined by at least a U-shaped minor top flap and an octagon-shaped major top flap, the U-shaped minor top flap and the octagon-shaped major top flap being connected to respective ones of the at least eight side panels.

9. The container of claim 1, wherein a bottom of the container is formed by at most four bottom flaps, the bottom panel being one of the at most four bottom flaps, each of the at most four bottom flaps being connected to a respective one of the at least eight side panels such that at least four of the eight side panels are not connected to any of the at most four bottom flaps forming the bottom of the container.

10. A beverage container comprising:

eight side panels having generally the same dimensions, one of the eight side panels including a first access opening integrally formed therein for permitting access to the interior of the container;

an octagonal top panel being connected to at least one of the eight side panels, the top panel forming a second access opening therein;

an octagonal bottom panel;

a flexible bag disposed within an enclosure defined by the eight side panels; and a plurality of gaps configured to assist in venting air from the container during insertion of the flexible bag within the enclosure, the plurality of gaps being formed by the eight side panels and the bottom panel, wherein the plurality of gaps includes eight bottom gaps, each of the eight bottom gaps being aligned with a respective fold line between adjacent ones of the eight side panels such that the bottom gaps are equally spaced around a perimeter of the container.

11. The container of claim 10, wherein the container has a footprint size defined by a length of about 6.35 cm to about 40.64 cm by a width of about 6.35 cm to about 40.64 cm.

12. The container of claim 10, wherein the container has a height of about 12.7 cm to about 76.2 cm.

13. The container of claim 10, wherein the flexible bag includes a mouth configured to extend through the first access opening.

14. The container of claim 10, wherein the flexible bag includes a spigot configured to extend through the first access opening.

15. The container of claim 10, further comprising a plurality of top gaps formed between the top panel and the eight side panels, each of the plurality of top gaps being aligned with a respective one of the plurality of bottom gaps formed between the bottom panel and the at least eight side panels.

16. The container of claim 10, wherein a bottom of the container is formed by at most four bottom flaps, the octagonal bottom panel being one of the at most four bottom flaps, each of the at most four bottom flaps being connected to a respective one of the eight side panels such that at least four of the eight side panels are not connected to any of the at most four bottom flaps forming the bottom of the container.

17. A beverage container comprising:

eight or more side panels, at least six of the eight or more side panels having generally the same dimensions and at least one of the eight or more side panels having a different dimension, each of the eight or more side panels having a height and a width, the width of the at least one of the eight or more side panels being greater than the width of the at least six of the eight or more side panels, one of the eight or more side panels including a first access opening integrally formed therein for permitting access to the interior of the container;

a top panel being connected to at least one of the eight or more side panels, the top panel forming a second access opening therein;

a bottom panel connected to at least one of the eight or more side panels; and a flexible bag disposed within an enclosure defined by the eight or more side panels, the flexible bag including a pour spout, the first access opening being configured to receive the pour spout, wherein the at least one of the eight or more side panels having the different dimension is the one of the eight or more side panels that includes the first access opening.

18. The beverage container of claim 17, wherein at least seven of the eight or more side panels have generally the same dimensions.

19. The beverage container of claim 17, wherein the second access opening is defined by at least a U-shaped minor top flap and an octagon-shaped major top flap, the U-shaped minor top flap and the octagon-shaped major top flap being connected to respective ones of the eight or more side panels.

* * * * *